US012590746B2

(12) United States Patent
Mitchell et al.

(10) Patent No.: US 12,590,746 B2
(45) Date of Patent: Mar. 31, 2026

(54) REFRIGERATOR AND ICE MAKING ASSEMBLY FOR PRODUCING HIGH-QUALITY ICE

(71) Applicant: Haier US Appliance Solutions, Inc., Wilmington, DE (US)

(72) Inventors: Alan Joseph Mitchell, Louisville, KY (US); Choonjae Ryu, Prospect, KY (US); Stephanos Kyriacou, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 142 days.

(21) Appl. No.: 18/511,385

(22) Filed: Nov. 16, 2023

(65) Prior Publication Data

US 2025/0164171 A1 May 22, 2025

(51) Int. Cl.
*F25C 1/24* (2018.01)

(52) U.S. Cl.
CPC ..... *F25C 1/24* (2013.01); *F25C 2300/00* (2013.01); *F25C 2400/10* (2013.01)

(58) Field of Classification Search
CPC ..... F25C 1/24; F25D 23/04; F25D 2317/061; F25D 21/06
See application file for complete search history.

(56) References Cited

U.S. PATENT DOCUMENTS

| | | | |
|---|---|---|---|
| 2,024,612 | A | 12/1935 | Sulzberger |
| 4,923,494 | A | 5/1990 | Karlovits |
| 5,177,980 | A | 1/1993 | Kawamoto et al. |
| 6,442,954 | B1 | 9/2002 | Shapiro et al. |
| 7,386,993 | B2 | 6/2008 | Castrellón et al. |
| 7,475,562 | B2 | 1/2009 | Jackovin |
| 8,516,845 | B2 | 8/2013 | Wuesthoff et al. |
| 9,448,003 | B2 | 9/2016 | Jin |
| 9,689,600 | B2 | 6/2017 | Jin |
| 9,759,471 | B2 | 9/2017 | Leclear et al. |
| 10,670,317 | B2 | 6/2020 | Wu |
| 11,073,320 | B2 | 7/2021 | Alshourbagy et al. |
| 11,131,493 | B2 | 9/2021 | Boarman et al. |
| 11,654,383 | B2 | 5/2023 | Mitchell et al. |

(Continued)

FOREIGN PATENT DOCUMENTS

| | | | |
|---|---|---|---|
| CN | 102297556 | B | 8/2015 |
| CN | 219199375 | U | 6/2023 |

(Continued)

OTHER PUBLICATIONS

KR-20090127211-A translation.*

*Primary Examiner* — Elizabeth J Martin
(74) *Attorney, Agent, or Firm* — Dority & Manning, P.A.

(57) ABSTRACT

A refrigerator appliance includes a cabinet, a door, an interior liner, an icemaker, a guide plate, and an electric heating element. The cabinet defines a chilled chamber. The door is movably mounted to the cabinet. The interior liner defines an icebox within the chilled chamber. The icemaker is mounted within the icebox. The guide plate is horizontally offset from the icemaker within the icebox. The guide plate defines a convection channel extending generally along a vertical direction from a channel inlet to a channel outlet disposed above the channel inlet. The electric heating element is disposed along the convection channel to heat air therein.

20 Claims, 5 Drawing Sheets

(56) References Cited

U.S. PATENT DOCUMENTS

| | | | | |
|---|---|---|---|---|
| 2004/0107726 | A1* | 6/2004 | Kim | F25D 17/045 62/159 |
| 2010/0147001 | A1 | 6/2010 | Kim et al. | |
| 2010/0251747 | A1 | 10/2010 | Lee | |
| 2011/0146325 | A1 | 6/2011 | Lee | |
| 2011/0162406 | A1 | 7/2011 | Shin et al. | |
| 2012/0272670 | A1 | 11/2012 | Choi et al. | |
| 2014/0260407 | A1* | 9/2014 | Boehringer | F25C 5/24 62/344 |
| 2019/0003758 | A1* | 1/2019 | Scalf | F25D 11/022 |
| 2022/0107127 | A1 | 4/2022 | Mitchell et al. | |
| 2022/0235991 | A1 | 7/2022 | Shi et al. | |
| 2022/0282898 | A1 | 9/2022 | Pagnozzi et al. | |
| 2023/0003431 | A1 | 1/2023 | Junge et al. | |
| 2023/0138774 | A1 | 5/2023 | Junge et al. | |

FOREIGN PATENT DOCUMENTS

| | | | | |
|---|---|---|---|---|
| EP | 4235067 | A1 | 8/2023 | |
| JP | 2003083661 | A | 3/2003 | |
| JP | 2007057198 | A | 3/2007 | |
| JP | 2010071565 | A | 4/2010 | |
| KR | 200283929 | Y1 | 1/2003 | |
| KR | 100559703 | B1 | 3/2006 | |
| KR | 2006060449 | A | 6/2006 | |
| KR | 20090127211 | A * | 12/2009 | F25C 1/24 |
| KR | 101581198 | B1 | 1/2016 | |
| KR | 2018117790 | A | 10/2018 | |
| KR | 102049659 | B1 | 11/2019 | |
| KR | 20210031250 | A | 3/2021 | |
| KR | 20220045406 | A | 4/2022 | |
| KR | 102422062 | B1 | 12/2022 | |
| KR | 20230132174 | A | 9/2023 | |
| WO | WO2008061179 | A2 | 5/2008 | |
| WO | WO2023088217 | A1 | 5/2023 | |

* cited by examiner

REFRIGERATOR AND ICE MAKING ASSEMBLY FOR PRODUCING HIGH-QUALITY ICE

FIELD OF THE DISCLOSURE

The present subject matter relates generally to refrigerator appliances and ice making assemblies for the same.

BACKGROUND OF THE DISCLOSURE

Certain refrigerator appliances include an icemaker for producing ice. The icemaker can receive liquid water, and such liquid water can freeze within the icemaker to form ice. In particular, certain icemakers include a mold body that defines a plurality of cavities. The plurality of cavities can be filled with liquid water that stays static within the cavities and can freeze within the plurality of cavities to form solid ice cubes. Typical solid cubes or blocks may be relatively small in order to accommodate a large number of uses, such as temporary cold storage and rapid cooling of liquids in a wide range of sizes.

Oftentimes, icemakers are placed in chilled (e.g., freezer) chambers withing a refrigerator appliance. In particular, icemakers are generally placed in the same chamber in which ice is held. In order to ensure ice is maintained, such chambers may need to be held at or below freezing temperatures. Such conditions, along with the ice-making features typically provided with the icemaker, often create ice that freezes relatively rapidly from the bottom up within the ice mold or cavities.

Although the typical solid cubes or blocks may be useful in a variety of circumstances, they have certain drawbacks. For instance, such typical cubes or blocks may be of a relatively low quality. Impurities may be captured within a cube and, in turn, lead to premature cracking or melting of the cube. Moreover, by freezing from the bottom up, the bottom of a cube may be more likely to stick to the mold cavity, making separation of the ice cube difficult. In some instances, the force required to remove an ice cube from the mold cavity may effectively limit the maximum feasible size for the icemaker.

In recent years, ice making appliances have been developed for forming relatively large ice billets in a manner that avoids trapping impurities and gases within the billet. Nonetheless, such systems have generally been very bulky and unfeasible for incorporation into a commercial refrigerator appliance. In particular, the inefficiency and large mass of these dedicated appliances have made them unsuitable for use within an appliance that also stores food items (e.g., within a fresh food chamber or freezer chamber).

BRIEF DESCRIPTION OF THE DISCLOSURE

Aspects and advantages of the invention will be set forth in part in the following description, or may be obvious from the description, or may be learned through practice of the invention.

In one exemplary aspect of the present disclosure, a refrigerator appliance is provided. The refrigerator appliance may include a cabinet, a door, an interior liner, an icemaker, a guide plate, and an electric heating element. The cabinet may define a chilled chamber. The door may be movably mounted to the cabinet. The interior liner may define an icebox within the chilled chamber. The icemaker may be mounted within the icebox. The guide plate may be horizontally offset from the icemaker within the icebox. The guide plate may define a convection channel extending generally along a vertical direction from a channel inlet to a channel outlet disposed above the channel inlet. The electric heating element may be disposed along the convection channel to heat air therein.

In another exemplary aspect of the present disclosure, an ice making assembly is provided. The ice making assembly may include an interior liner, an icemaker, a guide plate, an electric heating element, and an ice bucket. The interior liner may define an icebox. The icemaker may be mounted within the icebox. The icemaker may include an ice mold for receiving and freezing water. The ice mold may define a mold opening directed upward to receive water therethrough. The guide plate may be horizontally offset from the icemaker within the icebox. The guide plate may define a convection channel extending generally along a vertical direction from a channel inlet to a channel outlet disposed above the channel inlet. The electric heating element may be disposed along the convection channel to heat air therein. The ice bucket may be disposed below the icemaker and the convection channel.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
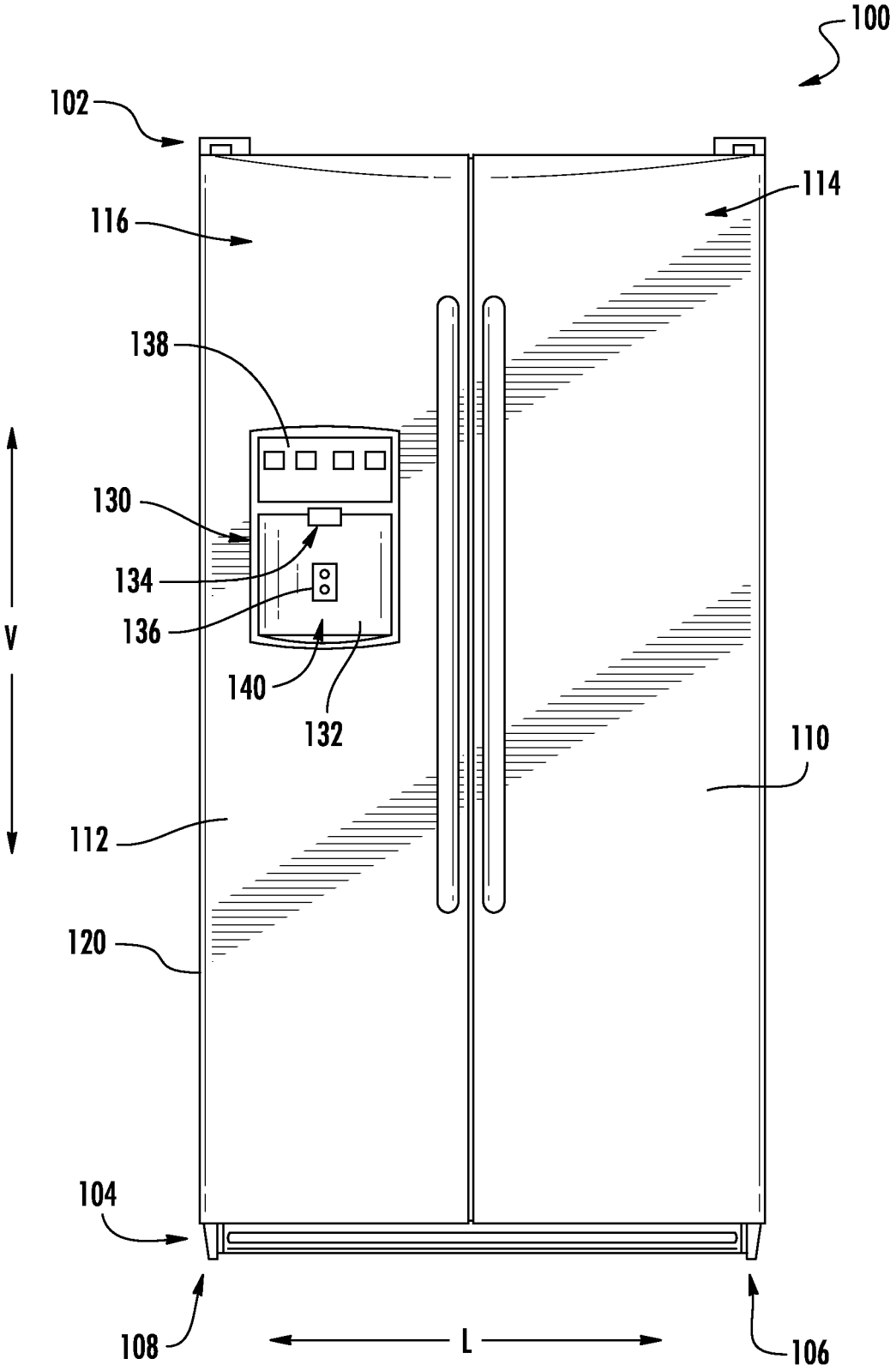
FIG. 1 provides a front elevation view of a refrigerator appliance according to example embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents. The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components or systems. For example, the approximating language may refer to being within a 10 percent margin (i.e., including values within ten percent greater or less than the stated value). In this regard, for example, when used in the context of an angle or direction, such terms include within ten degrees greater or less than the stated angle or direction (e.g., "generally vertical" includes forming an angle of up to ten degrees in any direction, such as, clockwise or counterclockwise, with the vertical direction V).

Except as explicitly indicated otherwise, recitation of a singular processing element (e.g., "a controller," "a processor," "a microprocessor," etc.) is understood to include more than one processing element. In other words, "a processing element" is generally understood as "one or more processing element." Furthermore, barring a specific statement to the contrary, any steps or functions recited as being performed by "the processing element" or "said processing element" are generally understood to be capable of being performed by "any one of the one or more processing elements." Thus, a first step or function performed by "the processing element" may be performed by "any one of the one or more processing elements," and a second step or function performed by "the processing element" may be performed by "any one of the one or more processing elements and not necessarily by the same one of the one or more processing elements by which the first step or function is performed." Moreover, it is understood that recitation of "the processing element" or "said processing element" performing a plurality of steps or functions does not require that at least one discrete processing element be capable of performing each one of the plurality of steps or functions.

Generally, improvements in the field of ice making and refrigerator appliances would be desirable. In particular, it may be desirable to provide a refrigerator appliance or ice making assembly capable of reliably and efficiently producing high-quality, solid ice cubes.

Figure 2:
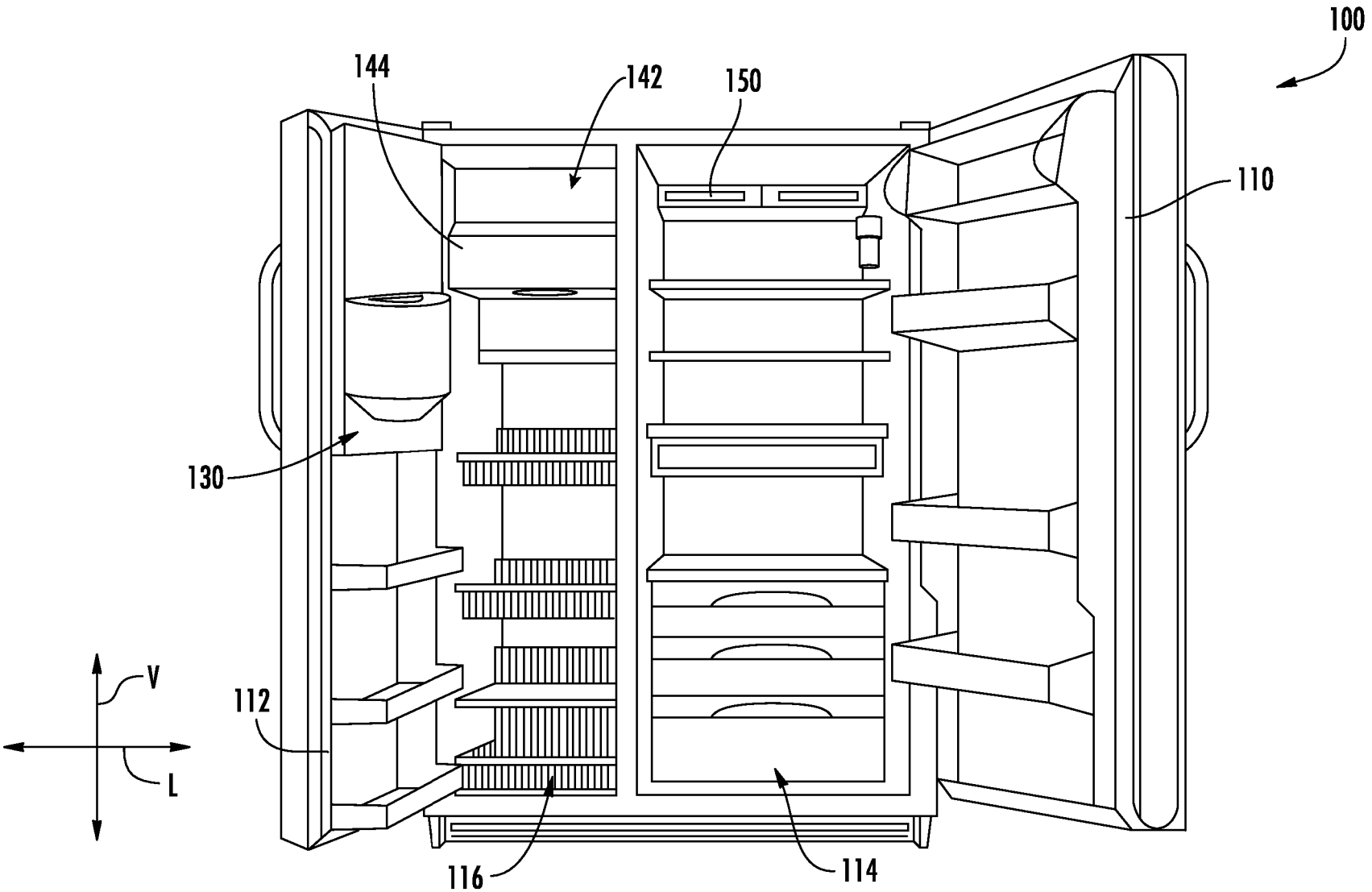
FIG. 2 provides a front elevation view of the example refrigerator appliance of FIG. 1, wherein the doors are shown in an open position.

Turning now to the figures, FIG. 1 provides a front, elevation view of a refrigerator appliance 100 according to an exemplary embodiment. FIG. 2 provides a front, elevation view of refrigerator appliance 100 with a refrigerator door 110 and a freezer door 112 of refrigerator appliance 100 shown in an open position to reveal a fresh food chamber 114 and a freezer chamber 116 of refrigerator appliance 100. Refrigerator appliance 100 defines a vertical direction V, a transverse direction T (FIG. 3), and a lateral direction L. The vertical direction V, transverse direction T, and lateral direction L are mutually perpendicular and form an orthogonal direction system. Refrigerator appliance 100 extends between an upper portion 102 and a lower portion 104 along the vertical direction V. Refrigerator appliance 100 also extends between a first side portion 106 and a second side portion 108 (e.g., along the lateral direction L).

Refrigerator appliance 100 includes a cabinet 120 that defines one or more chilled chambers for receipt of food items for storage. In particular, refrigerator appliance 100 defines fresh food chamber 122 at first side portion 106 of refrigerator appliance 100 and a freezer chamber 124 arranged next to fresh food chamber 122 at second side portion 108 of refrigerator appliance 100. As such, refrigerator appliance 100 is generally referred to as a side-by-side style refrigerator appliance. However, using the teachings disclosed herein, one of skill in the art will understand that the present subject matter may be used with other types of refrigerator appliances (e.g., bottom mount or top mount style) or a freezer appliance as well. Consequently, the description set forth herein is for illustrative purposes only and is not intended to limit the present subject matter in any aspect.

Refrigerator door 110 is rotatably hinged to an edge of cabinet 120 for accessing fresh food chamber 114. Similarly, freezer door 112 is rotatably hinged to an edge of cabinet 120 for accessing freezer chamber 116. Refrigerator door 110 and freezer door 112 can rotate between an open position (shown in FIG. 2) and a closed position (shown in FIG. 1) in order to permit selective access to fresh food chamber 114 and freezer chamber 116, respectively.

In some embodiments, refrigerator appliance 100 also includes a dispensing assembly 130 for dispensing water or ice. Dispensing assembly 130 may include a dispenser 132 positioned on or mounted to an exterior portion of refrigerator appliance 100 (e.g., on freezer door 112). Dispenser 132 may include a discharging outlet 134 for accessing ice and water. Any suitable actuator may be used to operate dispenser 132. For example, dispenser 132 can include a paddle or button for operating dispenser. A sensor 136, such as an ultrasonic sensor, may be mounted below discharging outlet 134 for operating dispenser 132 (e.g., during an auto-fill process of refrigerator appliance 100). A user interface panel 138 is provided for controlling the mode of operation. For example, user interface panel 138 may include a water dispensing button (not labeled) or an ice-dispensing button (not labeled) for selecting a desired mode of operation such as crushed or non-crushed ice.

Discharging outlet 134 and sensor 136 may be an external part of dispenser 130 and may be mounted in a dispenser recess 140 defined in an outside surface of freezer door 112. Dispenser recess 140 may be positioned at a predetermined elevation convenient for a user to access ice or water and enabling the user to access ice without the need to bend-over and without the need to access freezer chamber 116. In the exemplary embodiment, dispenser recess 140 is positioned at a level that approximates the chest level of a user.

Turning now to FIG. 2, certain components of an ice making assembly 200 are illustrated. As shown, ice making assembly 200 may include a housing or icebox 142 including an interior liner 146 defining an icebox 142 and being mounted within freezer chamber 116. As will be described in greater detail below, icebox 142 may contain an icemaker 202 (FIG. 3) for creating ice and feeding the same to an icebox or container 144 that is mounted therebelow (e.g., within freezer chamber 116 or on freezer door 112). As illustrated in FIG. 2, ice bucket 144 is placed at a vertical position that will allow for the receipt of ice from icemaker (e.g., below icemaker 202).

It is noted that although FIG. 2 illustrates icebox 142 and ice bucket 144 mounted directly to cabinet 120 within freezer chamber 116, alternative embodiments may provide portions (e.g., some or all) of ice making assembly 200 at another suitable location. For instance, icebox 142 (e.g., including interior liner 146) or ice bucket 144 may be indirectly attached to cabinet 120 (e.g., via door 112). As an example, interior liner 146 defining icebox 142 or ice bucket 144 may be mounted on an inner portion of door 112 to rotate therewith and be selectively received within freezer compartment (e.g., when door 112 is in a closed position). Thus, the interior liner 146 defining icebox 142 may be fixedly or selectively within a chilled chamber.

Operation of the refrigerator appliance 100 can be regulated by a controller 150 that is operatively coupled to user interface panel 138 or sensor 136. User interface panel 138 provides selections for user manipulation of the operation of refrigerator appliance 100 such as, for example, selections between whole or crushed ice, chilled water, or other options as well. In response to user manipulation of the user interface panel 138, controller 150 operates various components of the refrigerator appliance 100. Controller 150 may include a memory and one or more microprocessors, CPUs or the like, such as general or special purpose microprocessors operable to execute programming instructions or micro-control code associated with operation of refrigerator appliance 100. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 150 may be constructed without using a microprocessor (e.g., using a combination of discrete analog or digital logic circuitry; such as switches, amplifiers, integrators, comparators, flip-flops, AND gates, and the like) to perform control functionality instead of relying upon software.

Controller 150 may be positioned in a variety of locations throughout refrigerator appliance 100. In the illustrated embodiment, controller 150 is located at upper portion 102 or refrigerator appliance 100 within fresh food chamber 114. However, in alternative exemplary embodiments, controller 150 may be located within the control panel area of freezer door 112. Input/output ("I/O") signals may be routed between controller 150 and various operational components of refrigerator appliance 100. For example, user interface panel 138 may be in communication with controller 150 via one or more signal lines or shared communication busses.

Figure 3:
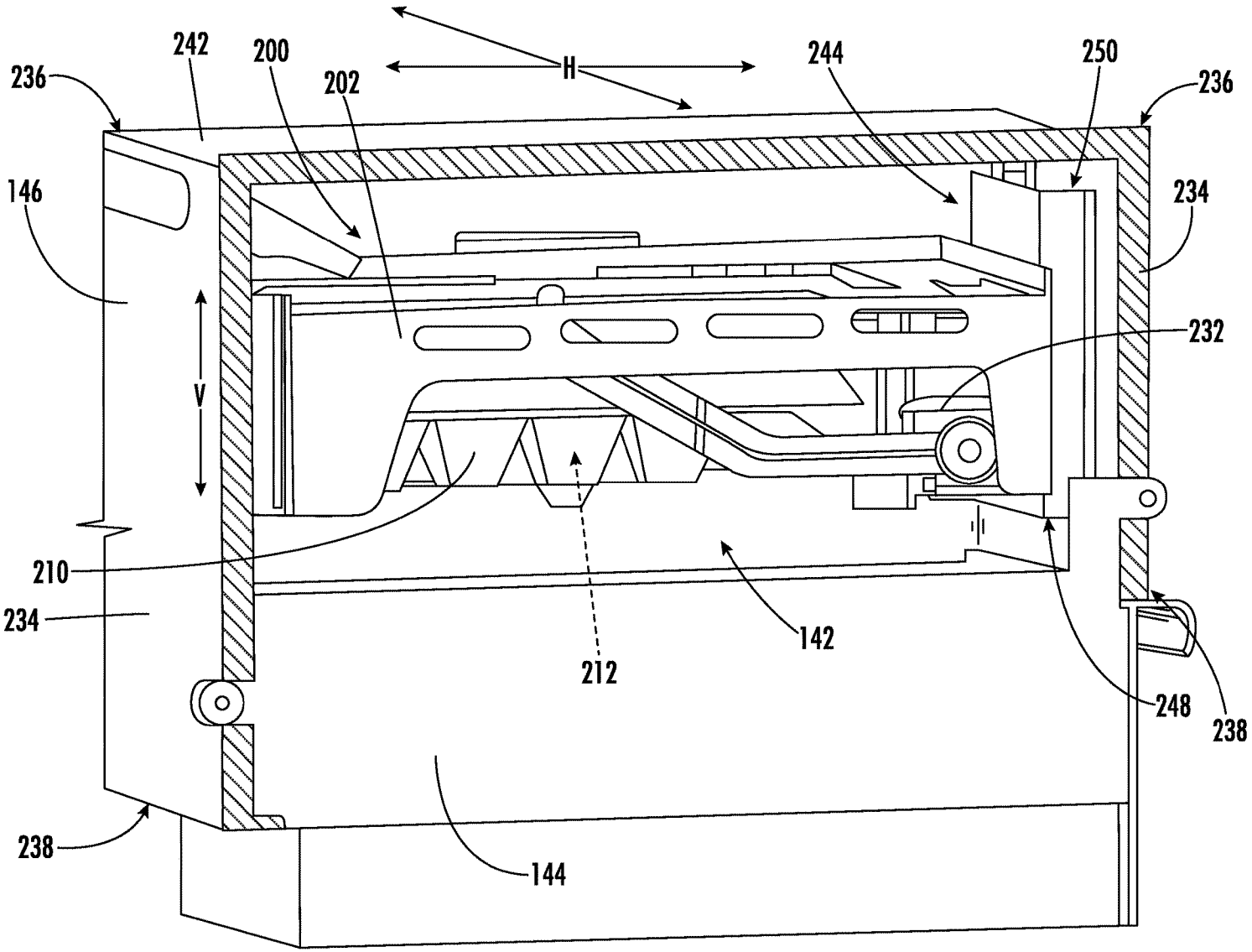
FIG. 3 provides a perspective view of an ice making assembly for a refrigerator appliance according to exemplary embodiments of the present disclosure.
Figure 4:
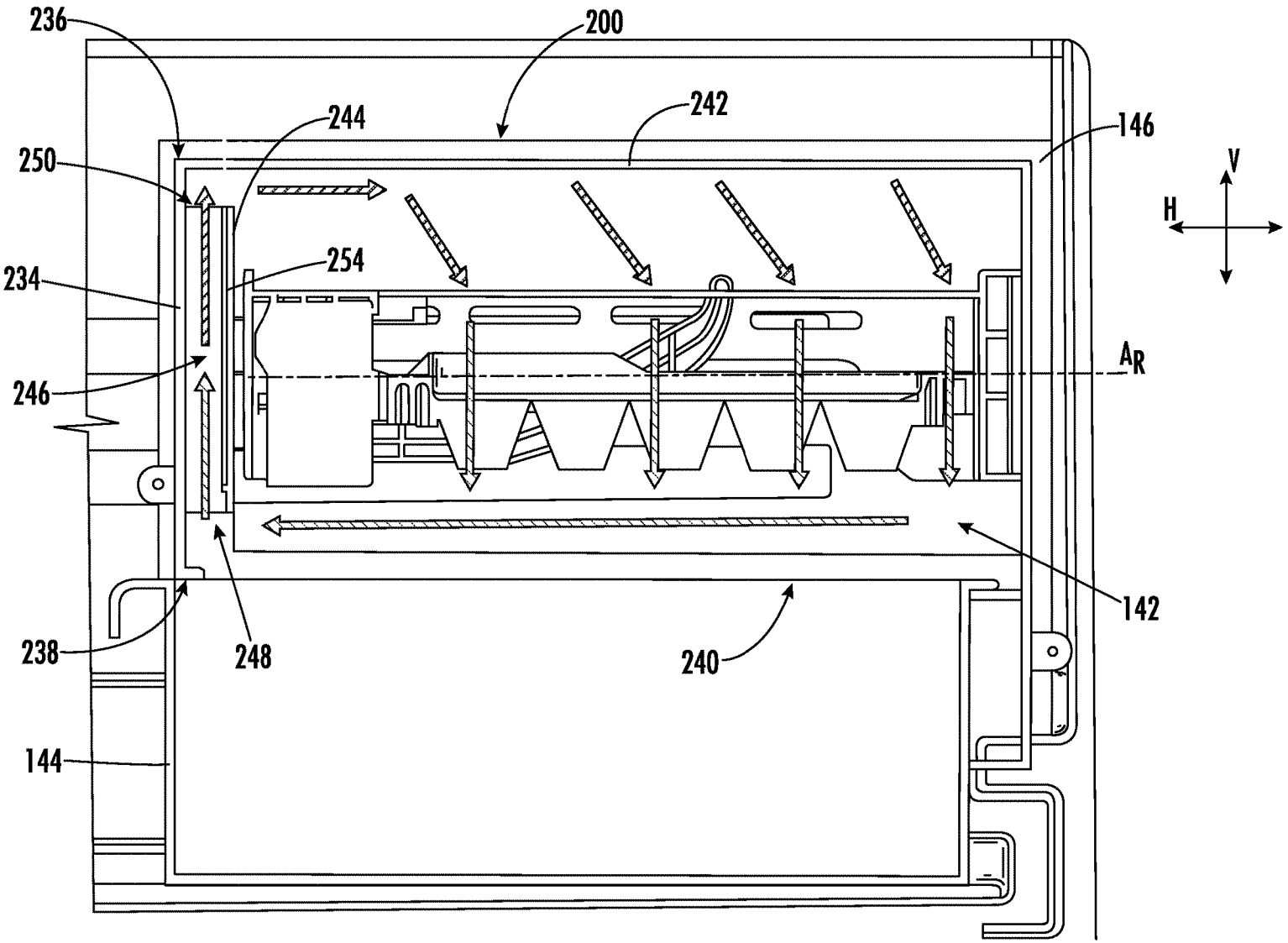
FIG. 4 provides a cross-sectional, elevation view of the exemplary ice making assembly of FIG. 3.
Figure 5:
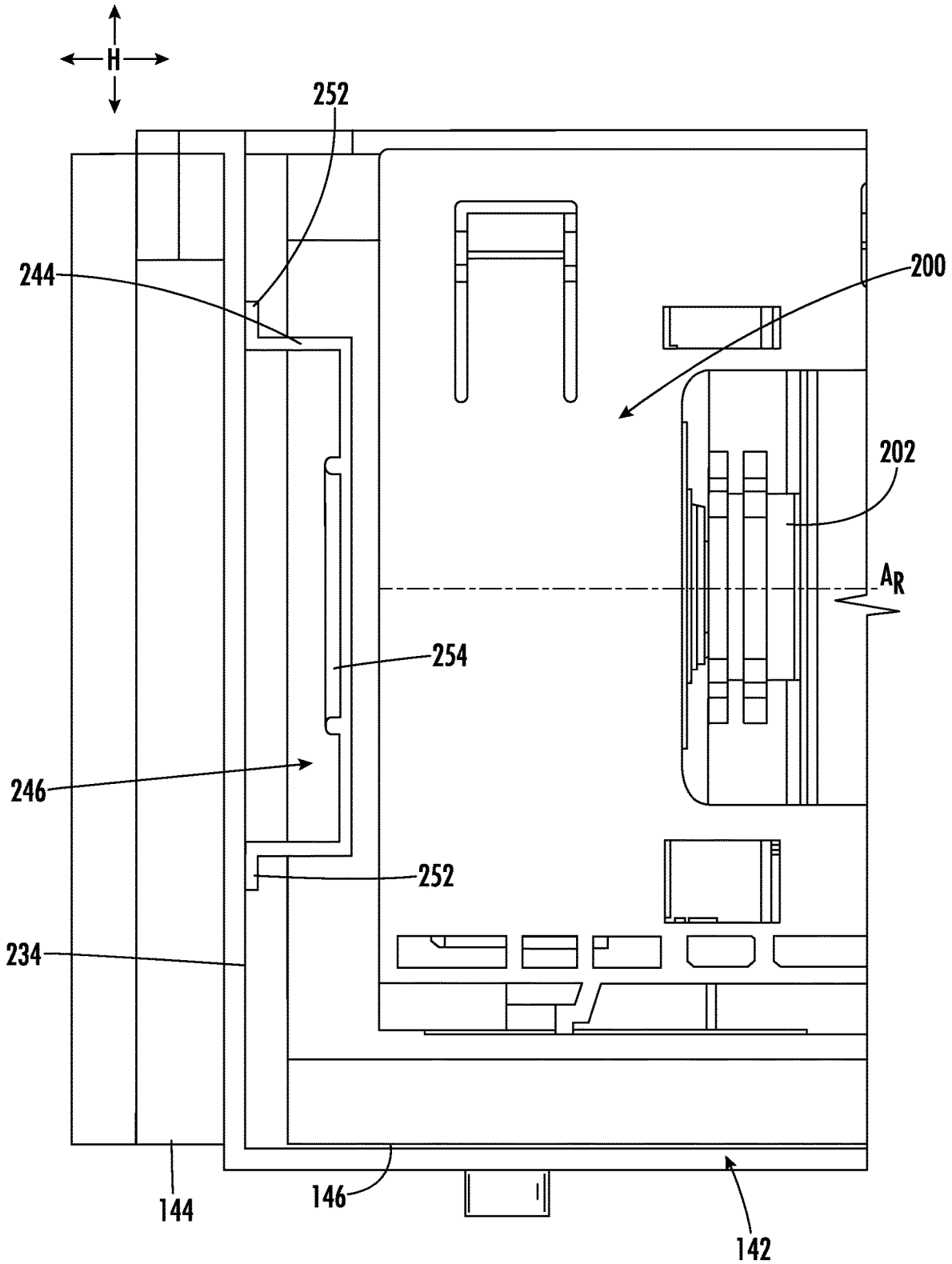
FIG. 5 provides a plan view of the exemplary ice making assembly of FIG. 3.

Turning now to FIGS. 3 through 5, FIG. 3 provides a perspective view of an ice making assembly 200 according to an exemplary embodiment of the present subject matter. FIG. 4 provides a cross-sectional, elevation view of ice making assembly 200. FIG. 5 provides a plan view of ice making assembly 200. Generally, ice making assembly 200 is configured for production of ice as discussed in greater detail below. Ice making assembly 200 may be used within any suitable refrigerator appliance, such as refrigerator appliance 100 (FIG. 1). As an example, ice making assembly 200 may be positioned within icebox 142 142 of refrigerator appliance 100.

Generally, ice making assembly 200 includes an icemaker 202 that generally defines an axial direction along a rotational axis $A_R$ (e.g., perpendicular to vertical direction V or parallel to a horizontal direction H), a circumferential direction, and a radial direction. Ice making assembly 200 also includes a mold body 210 that extends between a first end portion 214 and a second end portion 216 (e.g., along the axial direction A). Mold body 210 defines one or more cavities 212 for receipt of liquid water for freezing. Cavities 212 are spaced apart from one another or distributed (e.g., along the axial direction A between first end portion 214 and second end portion 216).

Ice mold or mold body 210 defines a mold opening for each cavity 212 that is directed upward to receive water therethrough. Within cavities 212 of mold body 210, liquid water can thus be received and freeze to from ice cubes. As will be understood by those skilled in the art, ice cubes within cavities 212 can adhere or stick to mold body 210 and, for example, hinder removal of such ice cubes from mold body 210. Thus, ice making assembly 200 includes features for assisting removal of ice cubes from mold body 210, such as to rotate mold cavity or a separate ejector about a rotational axis $A_R$ (e.g., parallel to an axial direction or horizontal direction H). In some such embodiments, ice making assembly 200 includes a motor 232 positioned within a motor housing (e.g., to rotate mold body 210 or an ejector about the rotational axis $A_R$ to loosen or dislodge ice cubes from the mold cavities 212 or mold body 210, as would be understood).

When assembled, icemaker 202 is mounted within icebox 142. In some embodiments, icemaker 202 is enclosed within icebox 142. For instance, the interior liner 146 may include one or more icebox (IB) sidewalls 234 that surround or horizontally bound icemaker 202. Thus, at least a portion of the IB sidewalls 234 may be disposed at a common height as icemaker 202 (e.g., relative to the vertical direction V). In some such embodiments, one or more IB sidewalls 234 extend generally along the vertical direction V between a top wall end 236 that is above (e.g., at a higher relative height than) icemaker 202 or mold body 210 and a bottom wall end 238 that is below (e.g., at a lower relative height than) icemaker 202 or mold body 210. Optionally, icemaker 202 may be mounted or secured to interior liner 146 (e.g., at one or more IB sidewalls 234). As shown, the IB sidewalls 234 may define a bottom opening 240 (e.g., at the bottom wall ends 238). The bottom opening 240 may be directly beneath all or some of icemaker 202. In optional embodiments, the ice bucket 144 is secured to or disposed below the icebox 142. For instance, ice bucket 144 may be secured to or disposed below bottom opening 240 (e.g., to selectively cover the same).

Separate from or in addition to IB sidewalls 234, the interior linear 146 may include an IB upper wall 242. For instance, IB upper wall 242 may extend over (e.g., directly above) icemaker 202. As shown, IB upper wall 242 may extend (e.g., horizontally) between the IB sidewalls 234, further enclosing icemaker 202 within icebox 142.

In some embodiments, a guide plate 244 (e.g., one or more guide plates 244) is disposed within icebox 142. For instance, guide plate 244 may be mounted to or supported on an IB sidewall 234 In some embodiments, guide plate 244 is offset from icemaker 202. Thus, guide plate 244 may be located at a separate position from icemaker 202. As will be described in greater detail below, guide plate 244 may define a convection channel 246 through which a convective airflow may be directed. As shown, guide plate 244 may be spaced apart (e.g., horizontally spaced apart) from icemaker 202. In turn, guide plate 244 may be out of contact with icemaker 202. An empty spacing or gap may be defined between guide plate 244 and icemaker 202 (e.g., along a horizontal direction H; such as lateral direction L or, alternatively, transverse direction T; or otherwise perpendicular to the vertical direction V). Separate from or in addition to being spaced apart from icemaker 202, guide plate 244 may be disposed at a common height with the icemaker 202 relative to the vertical direction V. Thus, at least a portion of guide plate 244 may be at the same height relative to the vertical direction V as the icemaker 202. In some such embodiments, guide plate 244 is horizontally aligned with the rotational axis $A_R$. As such, theoretical extension of the rotational axis $A_R$ from icemaker 202 may intersect guide plate 244 (e.g., notably providing guide plate 244 out of interference with icemaker 202 or ice cubes therefrom). Optionally, the guide plate 244 may further extend above (e.g., at a higher relative height than) icemaker 202. Additionally or alternatively, the guide plate 244 may further extend below (e.g., at a lower relative height than) icemaker 202.

As noted above, guide plate 244 defines a convection channel 246. When assembled, convection channel 246 extends generally or substantially along the vertical direction V. Specifically, convection channel 246 extends from a channel inlet 248 to a channel outlet 250 that is disposed above the channel inlet 248. In some embodiments, the channel inlet 248 is disposed below (e.g., to a lower relative height than) the icemaker 202 relative to the vertical direction V. Thus, channel inlet 248 may be lower than icemaker 202. In additional or alternative embodiments, channel outlet 250 is disposed above (e.g., to a higher relative height than) the icemaker 202 relative to the vertical direction V. Thus, channel outlet 250 may be higher than icemaker 202. As shown, all or some of convection channel 246 may be disposed above ice bucket 144. Thus, ice bucket 144 may be disposed below convection channel 246 or guide plate 244.

Guide plate 244 is generally provided as a solid member to guide air along the convection channel 246 (e.g., with or within icebox 142). In some embodiments, guide plate 244 comprises an enclosure (e.g., horizontally bounding the airflow within convection channel 246). Such an enclosure may extend from channel inlet 248 to channel outlet 250. In some such embodiments, the enclosure of guide plate 244 defines a horizontal C-shaped cross-section, which would be generally shaped like a "C" on the horizontal plate. Thus, the guide plate 244 may include a curved or multi-segment body that has an inner or channel-facing surface that at least partially wraps around convection channel 246 (e.g., to define the same). In certain embodiments, the guide plate 244 is attached to IB sidewall 234. For instance, one or more wings 252 may extend from terminal ends of the C-shaped cross-section (e.g., to be held against IB sidewall 234 via one or more mechanical fasteners, adhesives, welds, etc.). Together, IB sidewall 234 and the guide plate 244 (e.g., C-shaped cross-section) may bound or define convection channel 246.

In certain embodiments, an electric heating element 254 (e.g., resistive wire, radiant heating element, etc.) is disposed along convection channel 246 to heat air within (e.g., the airflow through) convection channel 246. For instance, electric heating element 254 may be mounted to or supported on guide plate 244. In some such embodiments, electric heating element 254 is disposed between channel inlet 248 and channel outlet 250 relative to the vertical direction V. In additional or alternative embodiments, electric heating element 254 is disposed between the convection channel 246 and the icemaker 202 relative to a horizontal direction H (e.g., lateral direction L or, alternatively, transverse direction T) or otherwise perpendicular to the vertical direction V. Thus, as traced along a horizontal direction H, the electric heating element 254 may be bounded on opposite horizontal sides by the convection channel 246 and the icemaker 202, respectively. In further additional or alternative embodiments, the electric heating element 254 is disposed on channel-facing surface of guide plate 244 or the enclosure thereof (e.g., within convection channel 246).

Electric heating element 254 is generally connected (e.g., in electrical communication) with a power source or controller (e.g., controller 150-FIG. 2). During use, selective activation of electric heating element 254 may generate heat and aid or facilitate a convective airflow through convection channel 246. Notably, the convective airflow may distribute and prevent stratification of heat within icebox 142. Advantageously, ice cubes formed within ice mold may be permitted to freeze from the top down. Cracks or impurities within the middle portions of the frozen cubes may be prevented. Additionally or alternatively, separation between the ice cubes and the mold body 210 may be notably encouraged (e.g., as the unfrozen water is held between the frozen ice cubes and mold body 210 prior to being frozen or permitted to remain unfrozen).

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance defining a vertical direction, the refrigerator appliance comprising:

a cabinet defining a chilled chamber;

a door movably mounted to the cabinet;

an interior liner defining an icebox within the chilled chamber;

an icemaker mounted within the icebox, the icemaker defining a rotation axis;

a guide plate horizontally offset from the icemaker within the icebox, the guide plate defining a convection channel extending generally along the vertical direction and perpendicular to the rotation axis from a channel inlet to a channel outlet disposed above the channel inlet; and an electric heating element disposed along the convection channel to heat air therein.

2. The refrigerator appliance of claim 1, wherein the guide plate is horizontally spaced apart from the icemaker at a common height relative to the vertical direction.

3. The refrigerator appliance of claim 1, wherein the interior liner comprises an icebox (IB) sidewall, and wherein the guide plate is mounted on the IB sidewall.

4. The refrigerator appliance of claim 1, wherein the icemaker defines a rotational axis, and wherein the guide plate is horizontally aligned with the rotational axis.

5. The refrigerator appliance of claim 1, wherein the guide plate comprises an enclosure defining a horizontal C-shaped cross-section.

6. The refrigerator appliance of claim 5, wherein the electric heating element is disposed on a channel-facing surface of the enclosure.

7. The refrigerator appliance of claim 5, wherein the electric heating element is disposed between the convection channel and the icemaker relative to a horizontal direction perpendicular to the vertical direction.

8. The refrigerator appliance of claim 1, wherein the channel inlet is disposed below the icemaker relative to the vertical direction.

9. The refrigerator appliance of claim 1, wherein the channel outlet is disposed above the icemaker relative to the vertical direction.

10. The refrigerator appliance of claim 1, further comprising an ice bucket disposed below the icemaker and the convection channel.

11. The refrigerator appliance of claim 1, wherein the icemaker comprises an ice mold for receiving and freezing water, the ice mold defining a mold opening directed upward to receive water therethrough.

12. An ice making assembly comprising:

an interior liner defining an icebox;

an icemaker mounted within the icebox, the icemaker comprising an ice mold for receiving and freezing water, the ice mold defining a rotation axis and a mold opening directed upward to receive water therethrough;

a guide plate horizontally offset from the icemaker within the icebox, the guide plate defining a convection channel extending generally along a vertical direction and perpendicular to the rotation axis from a channel inlet to a channel outlet disposed above the channel inlet;

an electric heating element disposed along the convection channel to heat air therein; and an ice bucket disposed below the icemaker and the convection channel.

13. The ice making assembly of claim 12, wherein the guide plate is horizontally spaced apart from the icemaker at a common height relative to the vertical direction.

14. The ice making assembly of claim 12, wherein the interior liner comprises an icebox (IB) sidewall, and wherein the guide plate is mounted on the IB sidewall.

15. The ice making assembly of claim 12, wherein the icemaker defines a rotational axis, and wherein the guide plate is horizontally aligned with the rotational axis.

16. The ice making assembly of claim 12, wherein the guide plate comprises an enclosure defining a horizontal C-shaped cross-section.

17. The ice making assembly of claim 16, wherein the electric heating element is disposed on a channel-facing surface of the enclosure.

18. The ice making assembly of claim 16, wherein the electric heating element is disposed between the convection channel and the icemaker relative to a horizontal direction perpendicular to the vertical direction.

19. The ice making assembly of claim 12, wherein the channel inlet is disposed below the icemaker relative to the vertical direction.

20. The ice making assembly of claim 12, wherein the channel outlet is disposed above the icemaker relative to the vertical direction.

* * * * *